US009776420B2

(12) United States Patent
Nitta

(10) Patent No.: US 9,776,420 B2
(45) Date of Patent: Oct. 3, 2017

(54) INKJET RECORDING APPARATUS AND INKJET RECORDING METHOD

(71) Applicant: TOSHIBA TEC KABUSHIKI KAISHA, Tokyo (JP)

(72) Inventor: Noboru Nitta, Kannami Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 210 days.

(21) Appl. No.: 14/567,433

(22) Filed: Dec. 11, 2014

(65) Prior Publication Data

US 2015/0103119 A1 Apr. 16, 2015

Related U.S. Application Data

(63) Continuation of application No. 13/031,555, filed on Feb. 21, 2011, now abandoned.

(30) Foreign Application Priority Data

Aug. 9, 2010 (JP) ..... 2010-179047

(51) Int. Cl.
*B41J 2/175* (2006.01)

(52) U.S. Cl.
CPC ..... *B41J 2/17596* (2013.01); *B41J 2/175* (2013.01)

(58) Field of Classification Search
CPC ..... B41J 2/175; B41J 2/17596; B41J 2/18
See application file for complete search history.

(56) References Cited

U.S. PATENT DOCUMENTS

| | | | | |
|---|---|---|---|---|
| 4,350,321 | A | 9/1982 | Berg | |
| 4,598,303 | A * | 7/1986 | Peekema | B41J 2/175 347/21 |
| 4,598,896 | A | 7/1986 | Maldavs | |
| 4,764,780 | A | 8/1988 | Yamamori et al. | |
| 5,796,419 | A * | 8/1998 | Clark et al. | 347/85 |
| 5,856,838 | A | 1/1999 | Oda et al. | |
| 5,937,899 | A | 8/1999 | Zeiber | |
| 5,992,987 | A | 11/1999 | Childers et al. | |
| 6,071,087 | A | 6/2000 | Jalink et al. | |

(Continued)

FOREIGN PATENT DOCUMENTS

| | | |
|---|---|---|
| JP | 2005-125670 | 5/2005 |
| JP | 2005-297447 | 10/2005 |

(Continued)

OTHER PUBLICATIONS

Japanese Office Action dated Jul. 9, 2013, filed in Japanese counterpart Application No. 2011-168614 (with English translation).

*Primary Examiner* — Matthew Luu
*Assistant Examiner* — Patrick King
(74) *Attorney, Agent, or Firm* — Patterson & Sheridan LLP

(57) ABSTRACT

According to embodiments, an inkjet recording apparatus includes an ink tank which contains ink, a printing head which is connected to the ink tank through an ink channel and ejects the ink from a nozzle surface, and a channel member which is provided in the ink channel and has a clearance gap that connects the ink channel to the outside. The channel member is provided in a part of the ink channel, which has a positive pressure with respect to the atmospheric pressure at least during a period in which the printing head is capable of printing.

16 Claims, 3 Drawing Sheets

(56) References Cited

U.S. PATENT DOCUMENTS

| | | | | |
|---|---|---|---|---|
| 6,217,164 | B1 * | 4/2001 | Hino | 347/85 |
| 6,224,198 | B1 | 5/2001 | Cook et al. | |
| 6,245,247 | B1 | 6/2001 | Silverbrook | |
| 6,520,630 | B1 | 2/2003 | Oda et al. | |
| 6,530,273 | B1 | 3/2003 | Gottlieb et al. | |
| 6,601,613 | B2 | 8/2003 | McNeely et al. | |
| 6,981,687 | B2 | 1/2006 | Field | |
| 7,296,881 | B2 | 11/2007 | Langford et al. | |
| 7,344,230 | B2 | 3/2008 | Moynihan | |
| 7,465,040 | B2 | 12/2008 | Malik et al. | |
| 7,524,044 | B2 | 4/2009 | Kumagai | |
| 7,565,917 | B2 | 7/2009 | Kamiya et al. | |
| 7,597,434 | B2 | 10/2009 | Nitta et al. | |
| 7,607,770 | B2 | 10/2009 | Inoue et al. | |
| 7,654,655 | B2 | 2/2010 | Malik et al. | |
| 7,711,453 | B2 | 5/2010 | Yo et al. | |
| 7,874,662 | B2 | 1/2011 | Silverbrook et al. | |
| 8,186,814 | B2 | 5/2012 | Aruga et al. | |
| 2001/0017642 | A1 | 8/2001 | Shigemura | |
| 2001/0022603 | A1 * | 9/2001 | Eida | 347/85 |
| 2002/0106920 | A1 | 8/2002 | Maldavs | |
| 2004/0099030 | A1 | 5/2004 | Twigg et al. | |
| 2004/0135853 | A1 | 7/2004 | Netsu et al. | |
| 2006/0001687 | A1 | 1/2006 | Bush et al. | |
| 2006/0017787 | A1 | 1/2006 | Inoue et al. | |
| 2006/0022158 | A1 | 2/2006 | Feinberg et al. | |
| 2007/0115333 | A1 | 5/2007 | Aruga et al. | |
| 2007/0206072 | A1 | 9/2007 | Morgan et al. | |
| 2007/0252860 | A1 | 11/2007 | Nitta et al. | |
| 2007/0285474 | A1 | 12/2007 | Murakami | |
| 2008/0079791 | A1 | 4/2008 | Kang et al. | |
| 2008/0158307 | A1 | 7/2008 | Nitta et al. | |
| 2008/0170108 | A1 | 7/2008 | Lee et al. | |
| 2008/0265574 | A1 | 10/2008 | Tiberghien et al. | |
| 2009/0015640 | A1 | 1/2009 | Nishida et al. | |
| 2009/0058917 | A1 * | 3/2009 | Takata | 347/18 |
| 2009/0174735 | A1 | 7/2009 | Yamada | |
| 2009/0195588 | A1 * | 8/2009 | Ogama | 347/17 |
| 2009/0201347 | A1 * | 8/2009 | Hamano | B41J 2/1707 347/85 |
| 2009/0219323 | A1 * | 9/2009 | Silverbrook | B41J 2/175 347/17 |
| 2009/0322818 | A1 * | 12/2009 | Iwasaki | 347/14 |
| 2010/0052313 | A1 | 3/2010 | Ishida et al. | |
| 2010/0079513 | A1 * | 4/2010 | Taira et al. | 347/7 |
| 2010/0079559 | A1 | 4/2010 | Justice et al. | |
| 2010/0134539 | A1 | 6/2010 | Nitta et al. | |
| 2011/0074887 | A1 * | 3/2011 | Manders et al. | 347/54 |
| 2011/0085010 | A1 | 4/2011 | Keshishian et al. | |
| 2011/0141209 | A1 | 6/2011 | Tsukamura et al. | |
| 2011/0267406 | A1 | 11/2011 | Hanson | |
| 2012/0001987 | A1 * | 1/2012 | Izawa | B41J 2/16526 347/85 |

FOREIGN PATENT DOCUMENTS

| | | |
|---|---|---|
| JP | 2007-313884 | 12/2007 |
| WO | 2010026905 | 3/2010 |

* cited by examiner

Cross section of channel when ink pressure is higher than atmospheric pressure

Cross section of channel when ink pressure is lower than atmospheric pressure

INKJET RECORDING APPARATUS AND INKJET RECORDING METHOD

CROSS-REFERENCE TO RELATED APPLICATIONS

This application is based upon and claims the benefit of priority from prior U.S. patent application Ser. No. 13/031,555, filed on Feb. 21, 2011, which claims the benefit of Japanese Patent Application No. 2010-179047, filed on Aug. 9, 2010, the entire contents of which are incorporated herein by reference.

FIELD

Embodiments described herein relate generally to an inkjet recording apparatus which perform recording by ejecting ink from nozzles of a printing head.

BACKGROUND

Inkjet recording apparatuses are configured to supply ink to a printing head from an ink tank through an ink channel, and eject ink from head nozzles.

In addition, a channel member such as a coupling and a valve is attached to the ink channel, and the printing head can be detachable from the coupling when, for example, the printing head is attached or detached. Besides, providing a valve between the head and the ink supply part can prevent ink from leaking and the air from entering the ink-supply side when the head is detached and the apparatus is transported, by closing the valve.

However, in prior art, there is the fear that the air enters the ink channel from the coupling or the valve while printing, and the air reaches the printing head together with the ink.

DETAILED DESCRIPTION

Figure 1:
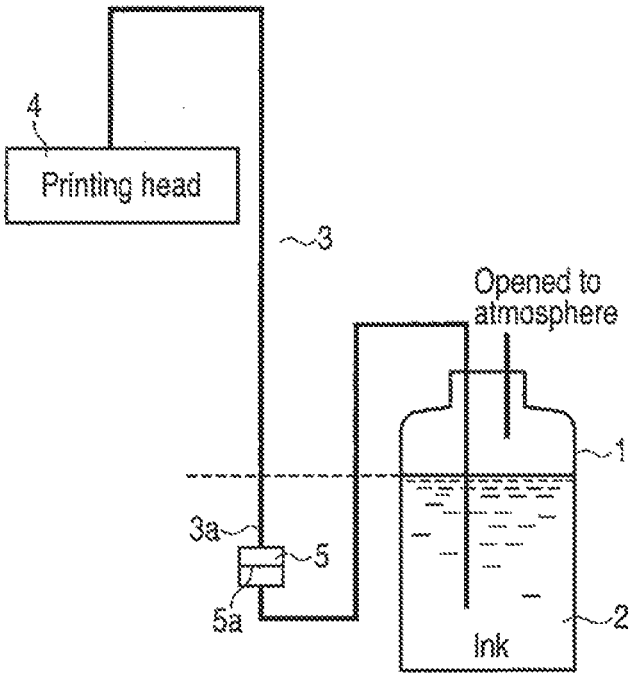
FIG. 1 is a structure diagram of an inkjet recording apparatus according to a first embodiment.

In general, according to embodiments, an inkjet recording apparatus comprises an ink tank which contains ink, a printing head which is connected to the ink tank through an ink channel and ejects ink from nozzles, and a channel member which is provided in the ink channel and includes a clearance gap which connect the ink channel to the outside, and the channel member is provided in a part which has a positive pressure with respect to the atmospheric pressure while the printing head can eject ink.

Embodiments will be described in detail hereinafter with reference to drawings.

Generally, when ink flows through a channel, the pressure of the ink in the channel is equal to the sum of dynamic pressure, that is, the kinetic energy per unit volume of ink, and static pressure. The dynamic pressure is proportional to density of ink and the flow velocity of ink. The flow velocity of ink is high around the center of a predetermined channel cross section thereof, and low around the peripheral part. Therefore, the dynamic pressure is high around the center of the channel cross section, and low around the peripheral part. Conversely, the static pressure is low around the center, and high around the peripheral part. When difference in height in a predetermined cross section of ink can be ignored, the pressure of ink which is the sum of static pressure and dynamic pressure is fixed in the cross section by Bernoulli's principle. The flow velocity of ink is 0 in a part close to the clearance gap in the ink channel described hereinafter, that is, a part close to a gas-liquid interface, and thus the pressure of the ink therein is only the static pressure.

Generally, the flow velocity of ink is sufficiently low in a channel which supplies ink to the inkjet head, and thus the dynamic pressure is sufficiently low. Specifically, it can be said that the pressure of ink which is the sum of static pressure and dynamic pressure is almost equal to the static pressure of ink.

A coupling and a valve which are provided in the ink channel which connects the ink tank and the printing head generally have a clearance gap, which is a slight opening to connect the ink channel to the outside. It is desirable that there is no such opening. However, a coupling has a movable part for attachment and detachment, and a valve has a movable part for switching channels. An opening is necessary for sliding the movable part. Even when the movable part is provided with a packing component made of rubber, it is very difficult to entirely remove, that is eliminate or seal, the opening. Packing components made of soft rubber is easily deteriorated by exposure to ink. In addition, some soft packing components may have an opening inside the packing material itself. Fluorine-containing rubber, which is not easily deteriorated by ink, has low repulsion and leaves an opening between the packing component and a member adjacent to the packing component. A member which is soft but has low restorability may make a new opening due to a history of deformation, when the movable part is once moved and then returned to its original position.

When a positive pressure with respect to the atmospheric pressure is applied to ink in the ink channel which has a channel member including a slight opening, force acts on the gas-liquid interface, which forms close to the opening, in a direction which would result in leaking the ink to the outside, due to the difference in pressure between the ink and the atmosphere. Simultaneously, a force pushing back on the ink acts on the gas-liquid interface due to surface tension, and this force and the force due to the difference in pressure are balanced. When the force due to the difference in pressure is greater than the force pushing back the ink due to surface tension, ink leaks outside.

Although the force which acts on the gas-liquid interface by difference in pressure is proportional to the area of the gas-liquid interface when difference in pressure is fixed, the force of pushing back ink by surface tension is not proportional to the area of the gas-liquid interface, and thus the channel with a narrower opening can endure larger difference in pressure.

Figure 3:
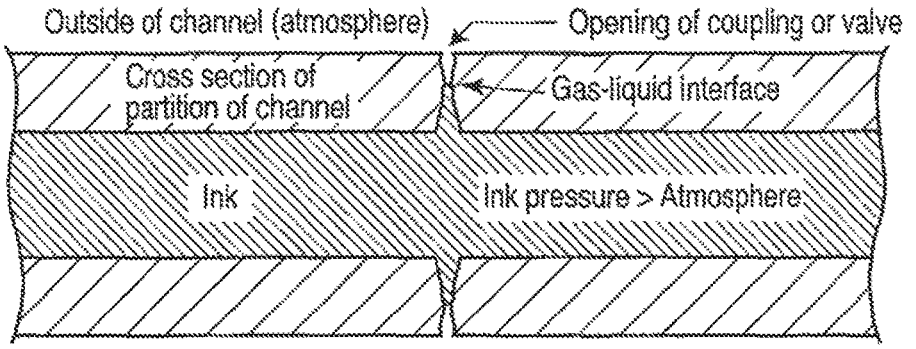
FIG. 3 is a schematic diagram illustrating a cross section of an ink channel when the ink pressure is higher than the atmospheric pressure.

Specifically, as illustrated in FIG. 3, the channel can endure the largest difference in pressure when ink goes to the narrowest part of the opening.

Conversely, when a pressure which is negative with respect to the atmospheric pressure is applied to ink in the channel, force by which the air is going to enter from the outside acts on the gas-liquid interface close to the opening.

Simultaneously, force of pushing back the air acts on the gas-liquid interface by surface tension, and the force and the force by difference in pressure are balanced. When the balance is lost, the air is mixed into the ink.

Although the force acting on the gas-liquid interface by difference in pressure is proportional to the area of the gas-liquid interface when the difference in pressure is fixed, the force of pushing back the air by surface tension is not proportional to the area of the gas-liquid interface. Therefore, the channel having the narrower opening can endure larger difference in pressure.

Figure 4:
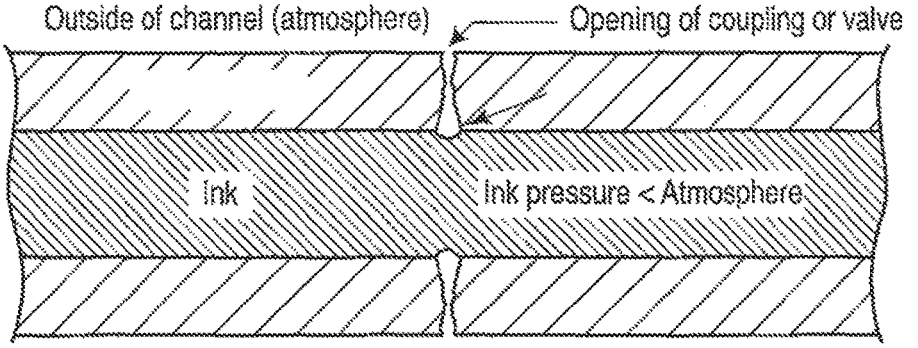
FIG. 4 is a schematic diagram illustrating a cross section of an ink channel when the ink pressure is lower than the atmospheric pressure.

Generally, the opening of the coupling and the valve is dry at the initial state, when the ink in the channel has negative pressure, the gas-liquid interface is formed inside the partition of the channel as illustrated in FIG. 4, and does not go toward the outside through the partition. Specifically, the part where the gas-liquid interface is formed when the ink has negative pressure is generally not the narrowest part of the opening, and the area of the gas-liquid interface is larger than the area in the case where the ink has positive pressure. As a result, balance between the forces is easily lost.

Therefore, design and manufacturing of couplings and valves which prevent entering of the air when the ink has negative pressure is more difficult than design and manufacturing of couplings and valves which prevent leakage of ink when the ink has positive pressure.

As a method of providing the gas-liquid interface in the narrowest part of the opening when the ink has negative pressure, there is a method of controlling the pressure of ink, in which ink is temporarily changed to positive pressure to wet the opening by ink and then ink is changed to negative pressure. However, this method requires accurate pressure control, and requires a cost increase.

Since it can be easily determined whether ink leaks from the opening, it can be easily determined whether the opening of the coupling or valve is sufficiently narrowed to prevent leakage of ink, when ink has positive pressure. On the other hand, since a slight quantity of air which is mixed into ink is not easily visible, it is difficult when ink has negative pressure to determine whether a slight quantity of air is mixed into ink.

Therefore, manufacturing and test of couplings and valves which prevent entering of the air when the ink has negative pressure is more difficult than manufacturing and test of couplings and valves which prevent leakage of ink when the ink has positive pressure.

When there is a valve in a position where ink has negative pressure and a slight quantity of air enters ink through the opening with a long time, it is very difficult to identify the fact.

The slight air which has entered the ink has a small volume, and has no influence as long as it adheres to the part where the air enters the ink. However, when the air gradually increases in volume and blocks the channel or reaches the head together with the flow of ink, the air causes the problem such as unstable ink ejection and sudden stop of ink ejection. For example, when a very small air bubble which does not influence ink ejection operation reaches a pressure chamber in the head during continuous printing, rectified diffusion caused by pressure oscillation in ink ejection acts on the air bubble, and the small air bubble grows to a size which impedes pressure generation during a time of few score minutes to few hours. In such a case, ink ejection suddenly stops at unexpected time.

Although unstable ink ejection and stop of ink ejection are problems, when such a problem suddenly occurs without being found, it causes mixing of unexpected printing errors into a printed matter, and making of a number of inferior printed matters. In particular, it becomes a serious problem in commercial printing and industrial printing such as print electronics, in which quality of printed matter determines its commercial value.

First Embodiment

FIG. 1 illustrates a non-ink-circulating inkjet recording apparatus according to a first embodiment.

Reference numeral 1 in FIG. 1 denotes an ink tank which contains ink 2. The ink tank 1 is opened to the atmosphere. The ink tank 1 is connected with a printing head 4 through an ink channel 3.

A part 3*a* in which pressure of 0 or more is applied to ink inside the channel is formed in a middle part of the ink channel 3. A coupling 5 serving as a channel member is attached to the part 3*a*. In the first embodiment, it suffices that the part 3*a* is located in a part as high as or lower than a liquid level of the ink tank 1.

The coupling 5 has a slight opening 5*a* which connects the ink channel 3 to the outside.

The coupling 5 is used when the printing head 4 is attached or detached.

Generally, to perform good printing, static pressure of ink close to openings of nozzles of the printing head 4 is set to negative pressure of about −1000 Pa. In the above structure, ink close to the openings of the nozzles of the printing head 4 has pressure which is negative by difference in potential pressure corresponding to difference in height between the liquid level of the ink tank 1 and the nozzle surface in which the openings of the nozzles are arranged. When ink is ejected from the nozzles, the negative pressure is going to increase, and thereby ink is supplied to the printing head 4 from the ink tank 1 through the ink channel 3.

In the meantime, since the coupling 5 has the slight opening 5*a* which connects the ink channel 3 to the outside, when the coupling 5 is located in a position higher than the liquid level of the ink tank 1, the air is going to enter the ink channel 3 through the opening 5*a* of the coupling 5.

However, according to the first embodiment, as described above, the coupling 5 is provided in the part 3*a* of the ink channel 3, where pressure which is positive with respect to the atmospheric pressure is applied to ink. This structure securely prevents entering of the air from the opening 5*a* of the coupling 5, and increases ink ejection reliability when the form is maintained at least during a period in which the printing head can eject ink.

Second Embodiment

Figure 2:
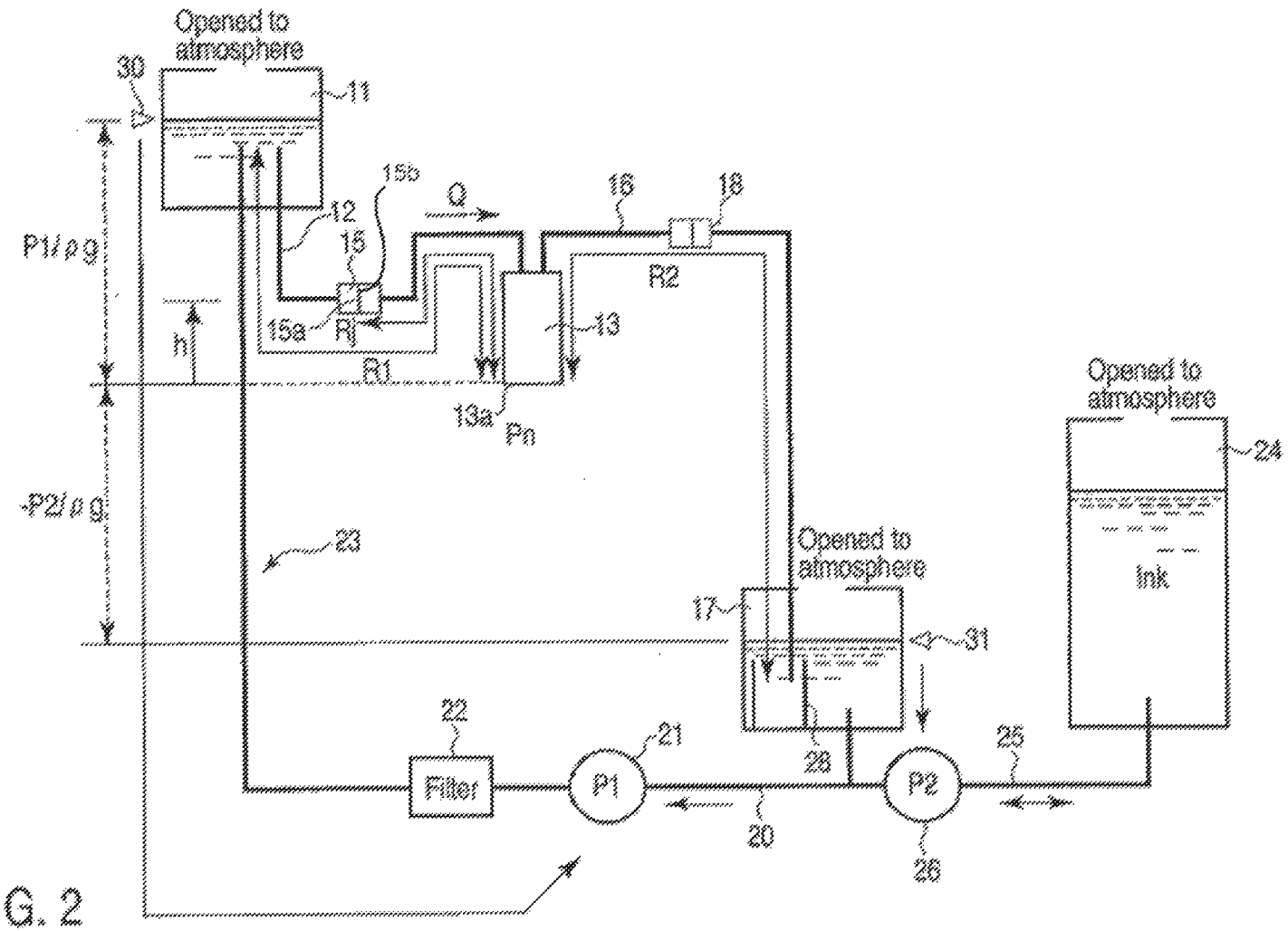
FIG. 2 is a structure diagram of an inkjet recording apparatus according to a second embodiment.

FIG. 2 illustrates an ink-circulating inkjet recording apparatus according to a second embodiment.

In FIG. 2, reference numeral 11 denotes an upstream subtank which serves as a first ink tank and is opened to the atmosphere. The upstream subtank 11 is connected with a printing head 13 through an upstream channel 12.

A coupling 15 is attached to a middle part of the upstream channel 12. A moving part 15*b* of the coupling 15 which is moved when the coupling 15 is detached or attached still has a slight opening 15*a*, which connects the upstream channel 12 to the outside, even when the coupling is fitted.

The printing head 13 is connected with a downstream subtank 17, which serves as a second ink tank, through a downstream channel 16. The downstream subtank 17 is opened to the atmosphere. An inlet of the downstream subtank 17 is provided with a decelerating bottle 28.

The decelerating bottle 28 decreases the flow velocity of ink which flows into the downstream subtank 17, and turns the direction of the ink upward. Thereby, even when the air is mixed into ink, the decelerating bottle 28 releases the air to the atmosphere from the liquid surface of the downstream subtank 17. A coupling 18 is attached to a middle part of the downstream channel 16.

Since the printing head 13 is connected to both the upstream channel 12 and the downstream channel 16, the two couplings 15 and 18 are provided to enable attachment/detachment of the printing head 13. A connection point (not shown) between the upstream channel 12 and the downstream channel 16 exists inside the printing head 13. The channel is branched toward nozzles (not shown) from the connection point, to eject ink from the nozzles.

The downstream subtank 17 is connected to the upstream subtank 11 through a return channel 20. A first pump 21 and a filter 22 are arranged in order along the flowing direction of ink in the middle part of the return channel 20, and a circulation channel 23 is formed.

A main tank 24 which is opened to the atmosphere is connected to an inlet side of the first pump 21 through an ink quantity control channel 25. A middle part of the ink quantity control channel 25 is provided with a second pump 26.

The above first pump 21 is a circulation pump, and returns ink of the downstream subtank 17 to the upstream subtank 11, when an upper level sensor 30 detects that the ink liquid level of the upstream subtank 11 is lowered. The second pump 26 is an ink quantity control pump, and supplies ink from the main tank 24 to the circulation channel 23, when a lower level sensor 31 detects that the liquid level of the downstream subtank 17 is lowered.

The upstream subtank 11 is provided in a first position, the printing head 13 is provided in a second position which is lower than the first position, and the downstream subtank 17 is provided in a third position which is lower than the second position.

In the above structure, by operating the first and the second pumps 21 and 26, ink is supplied to the printing head 13 while being circulated, and can be ejected from the nozzles of the printing head 13 when the printing head 13 is activated to be printing.

Energy per unit volume of ink in the above upstream subtank 11 is denoted by P1 (Pa), and energy per unit volume of ink in the downstream subtank 17 is P2 (Pa).

The energy per unit volume which ink has is the sum of potential pressure and static pressure based on ink of the atmospheric pressure at the height of the nozzles, and is uniform in each of the upstream subtank 11 and the downstream subtank 17. Since both the gas-liquid interface of the upstream subtank 11 and the gas-liquid interface of the downstream subtank 17 are opened to the atmosphere and the static pressure of each of them is 0, P1 and P2 are equal to the potential pressures of the gas-liquid interfaces of the upstream subtank 11 and the downstream subtank 17, respectively. Therefore, when the liquid levels of the subtanks are denoted by using P1 and P2, the liquid levels are P1/ρg(m), and P2/ρg(m), respectively, based on the height of the nozzles.

The symbol ρ(kg/m$^3$) denotes the density of ink, and the symbol g(m/s$^2$) denotes gravitational acceleration. In addition, since the gas-liquid interface of the downstream subtank 17 is lower than the nozzles, P2 and P2/ρg have negative values.

A dotted-line arrow in the lower left part of FIG. 2 denotes a distance in the height direction between the nozzles and the gas-liquid interface of the downstream subtank 17, not the height of the gas-liquid interface of the downstream subtank 17, and thus is −P2/ρg with a minus sign.

Supposing that the channel resistance of the upstream channel 12 from the upstream subtank 11 to the nozzle branch point in the printing head 13 is denoted by R1 (Pa·s/m$^3$), and the channel resistance of the downstream channel 16 from the nozzle branch point in the printing head 13 to the downstream subtank 17 is denoted by R2 (Pa·s/m$^3$), when the ejection flow rate ejected from the nozzles of the printing head 13 is sufficiently small, the flow rate of ink which flows through the circulation channel 23 is denoted by the following expression.

$$Q(m^3/\text{sec})=(P1-P2)/(R1+R2)$$

The static nozzle pressure Pn is denoted by the following expression.

$$Pn=P2+(P1-P2)(R2/(R1+R2))$$

The static nozzle pressure indicates the static pressure of ink located in the position of the nozzles which does not include pressure oscillation for ejection.

To perform good printing, Pn is set to a negative pressure of about −1000 Pa.

On the other hand, the upstream coupling 15 is disposed in a position which has a height of h from the nozzle surface 13*a* of the printing head 13.

When the static pressure of ink in the upstream coupling 15 is denoted by Pj, Pj is denoted by the following expression.

$$Pj=Pn-\rho gh+Q\cdot Rj$$

Rj denotes a channel resistance from the upstream coupling 15 to the nozzle branch point in the printing head 13.

The above values h, Q, and Rj are set such that the static pressure Pj of ink in the upstream coupling 15 is 0 or more. This setting prevents entering of the air from the opening 15*a* of the upstream coupling 15, and securely prevents sending ink into which the air is mixed to the printing head 13.

When Q and Rj have fixed values, h should be set to a value which is as low as possible. When h and Rj have fixed values, the condition can be easily satisfied by increasing the value of Q.

When the ejection flow rate ejected from the nozzles increases, a difference in flow rate occurs between the upstream channel and the downstream channel, and the static nozzle pressure is inclined toward the negative pressure side from the calculated value of Pn. When this change is not ignorable, the values of h, Q and Rj should be determined with the value of Pn inclined toward the negative pressure side for the change.

Supposing that the ejection flow rate ejected from the nozzles is qm in the present embodiment, flow rate Qu which flows into the printing head from the upstream channel is denoted by "Qu=Q+qm/2", and the flow rate which flows into the downstream channel from the printing head is denoted by "Ql=Q−qm/2". Therefore, The value obtained by "Qu−Ql=qm" is ejected from the nozzles.

In the above state, the static pressure Pj in the upstream coupling 15 is denoted by the following expression.

$$\begin{aligned} Pj &= pg\cdot(P1/pg-h)-Qu\cdot(R1-Rj) \\ &= (P1-pgh)-Qu\cdot(R1-Rj) \end{aligned}$$

Specifically, the values of h, Q, Rj should be determined such that the value of Pj of the above expression is 0 or more.

On the other hand, since the static pressure of ink in the downstream coupling 18 is generally a negative pressure, the air is mixed into ink when the downstream coupling 18 has a slight opening. However, since the air mixed into ink through the downstream coupling 18 is released to the atmosphere in the downstream subtank 17, even when a slight quantity of air is mixed into ink, it does not have bad influence on the ink ejection reliability.

As described above, according to the second embodiment, the values of h, Q, and Rj are set such that the static pressure Pj of ink in the upstream coupling 15 is 0 or more, no air enters from the opening 15*a* of the upstream coupling 15, or is sent to the printing head. The ink ejection reliability of the printing head 13 can be maintained at good quality, when the above state is maintained at least during a period in which the printing head can eject ink.

Although the above embodiment shows a case where the coupling 15 is attached to the ink channel, the embodiment is not limited to it. When a valve is attached to the ink channel, the position of the valve should be selected in the same manner. Generally, when there is a channel member which has a slight opening that connects the upstream channel to the outside, the position of the channel member should be selected in the same manner as the present embodiment.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet recording apparatus comprising:

an upstream ink tank which contains ink;

a printing head configured to eject ink from a nozzle opening for printing, where a static pressure of ink close to the nozzle opening is set to negative pressure;

an upstream ink channel which supplies the ink contained in the upstream ink tank to the printing head; and an upstream coupling comprising a sliding portion which slides during attachment/detachment of the printing head to the upstream ink tank, where an inner side of the upstream coupling contacts the ink in the upstream ink channel and an outer side of the upstream coupling is exposed to atmospheric pressure, the upstream coupling being included inside the upstream ink channel, the upstream coupling being attached to a part of the upstream ink channel having an ink pressure of zero or more with respect to the atmospheric pressure at least during a period in which the printing head is capable of printing such that a pressure on the inner side of the upstream coupling is not a negative pressure.

2. The inkjet recording apparatus of claim 1, further comprising:

a downstream ink tank which contains ink and is disposed downstream of the printing head.

3. The inkjet recording apparatus of claim 2, further comprising:

a downstream ink channel which supplies ink from the printing head to the downstream ink tank, and a downstream coupling for attachment/detachment of the printing head to the downstream ink channel.

4. The inkjet recording apparatus of claim 3, further comprising:

a return channel which connects the downstream ink tank and the upstream ink tank and forms a circulation channel with the upstream ink channel and the downstream ink channel.

5. The inkjet recording apparatus of claim 4, further comprising:

a pump provided in the return channel, the pump feeding the ink in the downstream ink tank to the upstream ink tank.

6. The inkjet recording apparatus of claim 5, wherein the upstream coupling for attachment/detachment of the printing head is positioned higher than a nozzle surface of the printing head by h, and wherein values of h, Q and Rj are set such that a value of expression "$Pn-\rho gh+Q\cdot Rj$" is zero or more, a value of $\rho$ is density of ink, the value of Q is a flow rate of ink flowing through the circulation channel, the value of Rj is a flow channel resistance from the upstream coupling to a nozzle branch in the printing head, and a value of Pn is a static nozzle pressure, which is static pressure of ink at a nozzle position not including pressure oscillation for ejection.

7. The inkjet recording apparatus of claim 5, wherein an ink static pressure of an inner side of the downstream coupling is a negative pressure at least during a period in which the printing head is capable of printing.

8. The inkjet recording apparatus of claim 1, wherein a part to which the upstream coupling is attached is a middle part of the upstream channel.

9. An inkjet recording method comprising:

connecting an upstream ink tank which contains ink to a printing head through an upstream ink channel and an upstream coupling for attachment/detachment of head;

supplying ink contained in the upstream ink tank to the printing head;

ejecting the ink from nozzle surface of the printing head for printing; and setting a static pressure of the ink close to a nozzle opening to negative pressure at least during a period in which the printing head is capable of printing;

wherein an outer side of a sliding portion at attachment/detachment of the upstream coupling for attachment/detachment contacts atmospheric pressure and an ink of an inner side maintains a pressure of zero or more with respect to atmospheric pressure and an upstream ink channel with negative pressure is not provided with a coupling having the sliding portion at attachment/detachment.

10. The inkjet recording method of claim 9, wherein a downstream ink tank which contains ink is disposed downstream of the printing head.

11. The inkjet recording method of claim 10, wherein a downstream ink channel supplies the ink goes out from the printing head to the downstream ink tank through a downstream coupling for attachment/detachment of the head.

12. The inkjet recording method of claim 11, wherein a return channel connects the downstream ink tank and the upstream ink tank and forms a circulation channel with the upstream ink channel and the downstream ink channel.

13. The inkjet recording method of claim 12, wherein a pump is provided on the return channel and feeds the ink of the downstream ink tank to the upstream ink tank.

14. The inkjet recording method of claim 13, wherein the printing head comprises a nozzle surface disposed on a nozzle opening which ejects ink at a predetermined height and a nozzle branch which connects the upstream channel, the downstream channel and a channel branching to the nozzle.

15. The inkjet recording method of claim 14, wherein the upstream coupling for attachment/detachment is positioned higher than the nozzle surface of the printing head by h, and values of h, Q and Rj are set such that a value of expression "$Pn-\rho gh+Q\cdot Rj$" is zero or more, when density of ink is $\rho$, flow rate of ink flowing through the circulation channel is Q, flow channel resistance from the upstream coupling to the nozzle branch in the printing head is Rj, static nozzle pressure, which is static pressure of ink at a nozzle position not including pressure oscillation for ejection is Pn.

16. The inkjet recording method of claim 15, wherein an ink static pressure of an inner side of the downstream coupling being negative pressure at least during a period in which the printing head is capable of printing.

* * * * *